United States Patent [19]

Csaszar

[11] Patent Number: 4,848,513

[45] Date of Patent: Jul. 18, 1989

[54] NOISE ABATEMENT MUFFLER

[75] Inventor: Gabor Csaszar, Crystal Lake, Ill.

[73] Assignee: Ced's, Inc., Addison, Ill.

[21] Appl. No.: 142,072

[22] Filed: Jan. 11, 1988

[51] Int. Cl.[4] ..... F01N 1/10

[52] U.S. Cl. ..... 181/265; 181/231; 181/239; 181/258; 181/264; 181/272

[58] Field of Search ..... 181/239, 256, 258, 265, 181/266, 272, 231, 264

[56] References Cited

U.S. PATENT DOCUMENTS 2,618,354 12/1952 Hedrick ..... 181/266

4,056,934 11/1977 Mizusawa et al. ..... 181/265 X 4,700,805 10/1987 Tanaka et al. ..... 181/265

*Primary Examiner*—B. R. Fuller

*Attorney, Agent, or Firm*—Laff, Whitesel, Conte & Saret

[57] ABSTRACT

The invention is directed to a compact noise abatement muffler for an internal combustion engine. The muffler includes a housing having a plurality of chambers and fluid conductors for enabling the exhaust gases passing through the muffler to achieve at least 4 changes of direction of gas flow. The muffler of the invention is capable of reducing the sound pressure level of the exhaust gases between the input and exhaust ports of the muffler in the range of 10–25 decibels.

21 Claims, 2 Drawing Sheets

NOISE ABATEMENT MUFFLER

FIELD OF THE INVENTION

The present invention generally relates to devices for reducing the sound levels of the exhaust emissions of internal combustion engines.

BACKGROUND OF THE INVENTION

Mufflers for internal combustion engines, such as stationary, small horsepower engines commonly used in portable generators and lawn mowers and the like, are known in the art. Typically, these mufflers comprise single, elongated tubes housed within bulky, metallic shells, which change the direction of the sound waves to reduce the noise of the escaping gaseous products of combustion.

The mufflers of the prior art have not been satisfactory since they have been generally unable to reduce the difference in sound pressure levels between the input and exhaust sides of the muffler by more than a few decibels. As a result, the mufflers of the prior art have not been able to compete with imported mufflers which have been designed to comply with the stricter standards of the European Common Market. A need therefore exists for a muffler which is capable of significantly reducing the sound pressure levels of the exhaust gases of internal combustion engines, compete with the quieter import models, and is capable of meeting the stricter standards of the European Common Market.

SUMMARY OF THE INVENTION

The present invention is directed to a noise abatement muffler for an internal combustion engine. The muffler of the present invention may be used with low horsepower, stationary engines as may be found in lawn mowers, portable generators, and similar types of internal combustion engine powered tools. The muffler of the invention is capable of reducing the sound pressure level of the exhaust gases between input and exhaust sides of the muffler by 15–20 decibels.

The muffler of the present invention includes a metallic shell having an inlet port for conducting exhaust gases through a first fluid conductor to the first of a series of chambers within the muffler. The exhaust gases pass through two additional chambers before they are directed to an exhaust port comprising a plurality of relatively small holes provided on the outer surface of the shell. The exhaust port is located within a chamber intermediate between two of the serially arranged chambers contained within the shell. Typically, the exhaust ports direct the gas escaping from the muffler to a spark arrester.

The presently disclosed muffler comprises three serially arranged chambers, two of which chambers are interconnected by a second fluid conductor for transferring exhaust gases received in the first chamber by the first fluid conductor to a second chamber in a direction which is opposite to the flow of gases transported by the first fluid conductor. The serially arranged chambers are separated from each other by partition members which define at least one intermediate third chamber disposed between the first two chambers. The partition member defining the first chamber, which receives exhaust gases transported by the first fluid conductor, is devoid of apertures so as to insure that all the exhaust gases are transported from the first chamber through the second fluid conductor and into the second chamber.

The partition member separating the second and third chambers in the muffler includes a plurality of apertures on a portion opposite the location of the exhaust port of the metallic shell to enable exhaust gases passing to the third chamber from the second chamber to flow into the third chamber and to subsequently exit the muffler through the exhaust port.

DETAILED DESCRIPTION OF THE INVENTION

Figure 1:
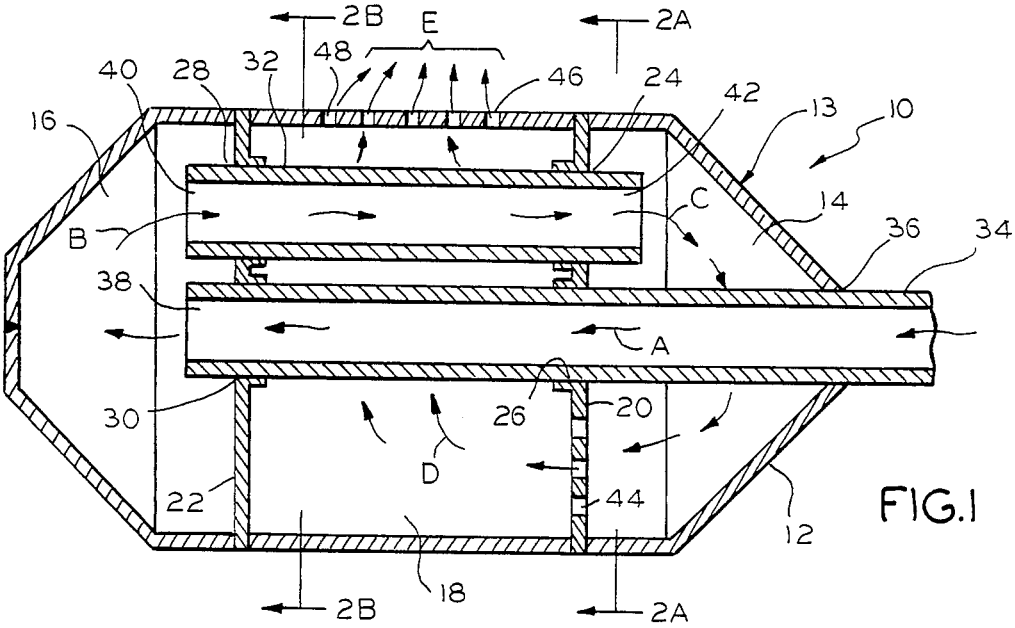
FIG. 1 is a side, cross-sectional view of the muffler according to the present invention showing the serially connected chambers, partition members, and fluid conductors.
Figure 2B:
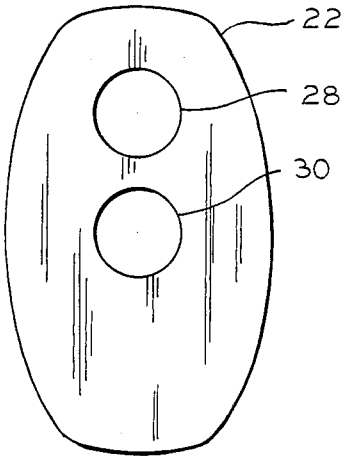
FIGS. 2A and 2B are elevation views of the partition members defining the chambers within the muffler, taken along lines 2A—2A and 2B—2B in FIG. 1.
Figure 2A:
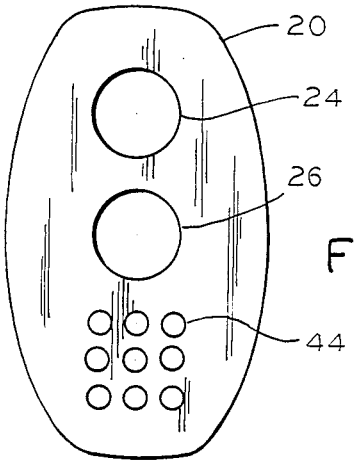

The noise abatement muffler of the invention and its manner of function will no be explained in detail by reference to the drawings wherein like numerals refer to like components. As shown in FIG. 1, the muffler, shown generally at 10, comprises two outer metallic shell halves 12 and 13 (FIG. 2B) which are placed together, as by welding, and divided into at least one forward chamber 14 and a rear chamber 16 separated by an intermediate chamber 18. Chamber 14 is separated from intermediate chamber 18 by porous partition member 20. Similarly, rear chamber 16 is separated from intermediate chamber 8 by a non-porous partition member 22. Partition members 20 and 22, as can be seen in FIGS. 2 and 2A, have openings 24, 26 and 28, 30 therein respectively for receiving and supporting first and second fluid conducting members 34 and 32.

First fluid conductor 34 is sealably engaged, as for example, by welding, with shell 12 at inlet port 36. First fluid conductor means 34 is supported in air tight engagement, such as by welding, with partition members 20 and 22 within openings 26 and 30. Similarly, second fluid conducting means 32 is supported in air tight engagement with partition members 20 and 22 in openings 24 and 28.

During operation of muffler 10, exhaust gases pass from the engine to which muffler 10 is connected through fluid conductor 34 in the direction of arrow A to rear chamber 16 through opening 38. The exhaust gases in chamber 16 then undergo a change of direction, as in the direction of arrow B, to flow through opening 40 and into second fluid conductor 32 to forward chamber 14, passing through opening 42. The exhaust gases in forward chamber 14 then undergo a further change of direction as shown by arrow C to pass through holes 44 of porous partition member 20 into intermediate or third chamber 18. Preferably, and as shown in FIG. 1, holes 44 are located in that portion of partition member 20 which is most distant from exhaust port 46. The exhaust gases again undergo a change of direction within chamber 18 to flow in the direction of arrow D to exit the muffler through exhaust port 46.

Exhaust port 46, located on shell half 12 at an acute angle, such as 90 degrees relative to inlet port 36, includes a plurality of apertures 48 to permit escape of the exhaust gases from the muffler. The number of apertures 48 provided in exhaust port 46 can be readily chosen by those skilled in the art so as to regulate the degree of backpressure desired in the muffler. Typically, the gases escape the muffler 10 through apertures 48 as shown by the arrows E, and pass through a spark arrester (not shown) and then to atmosphere.

As described above, and as can be seen in FIG. 1, the exhaust gases flowing through the muffler of the present invention undergo at least four changes of direction. These changes in direction in a small sized unit enable the muffler 10 to achieve an unexpected reduction in sound pressure levels of about 15–20 decibels between the inlet port and the exhaust port. Also, the apertures 44 in partition 20 and apertures 48 forming exhaust port 46 lower the noise emanating from the muffler 10 by altering the frequency of the moving exhaust gases. The apertures 44 and 48, therefore, establish the timing, and thus the noise, of the exhaust process, by regulating the exhaust gas back-pressure.

Figure 3:
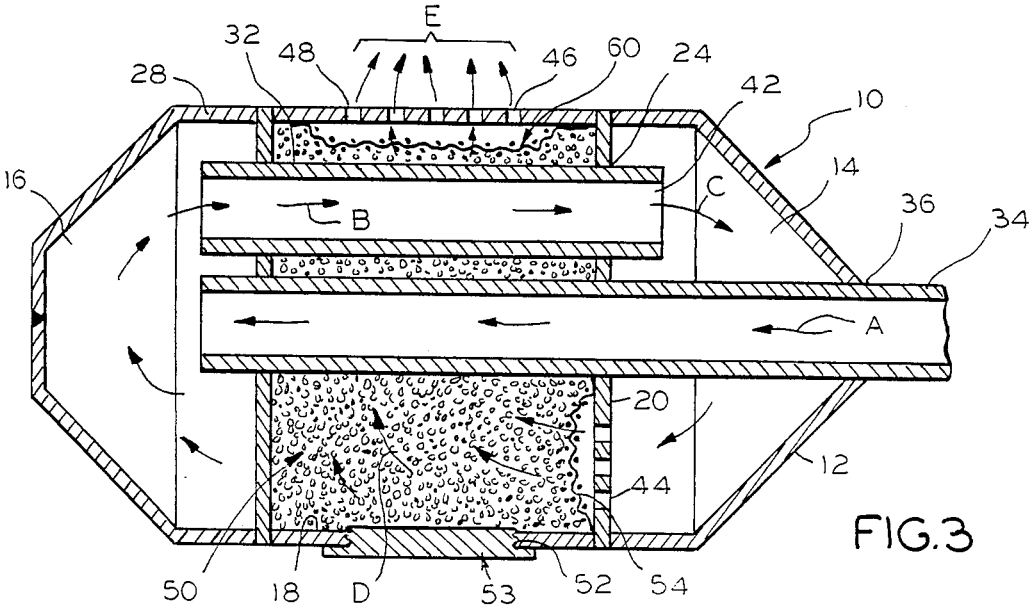
FIGS. 3 are side 3A cross-sectional views of alternative embodiments of the muffler of the present invention, wherein catalyst materials are provided in one of the chambers.

In an alternative embodiment, and as shown in FIG. 3, where like parts are indicated by the numerals shown in FIG. 1, the muffler of the present invention may include a catalyst comprising a number of ceramic catalyst pellets 50 in chamber 18 to reduce the hydrocarbon, carbon monoxide and nitrous oxide emissions of the exhaust gases of the internal combustion engine. As shown in FIG. 3, ceramic catalyst pellets 50 are provided in intermediate chamber 18. Pellets 50 may be inserted in and removed from chamber 18 by passing them through opening 52 provided in lower shell 12. Pellets 50 are retained in chamber 18 by a removable cap 53.

Figure 4:
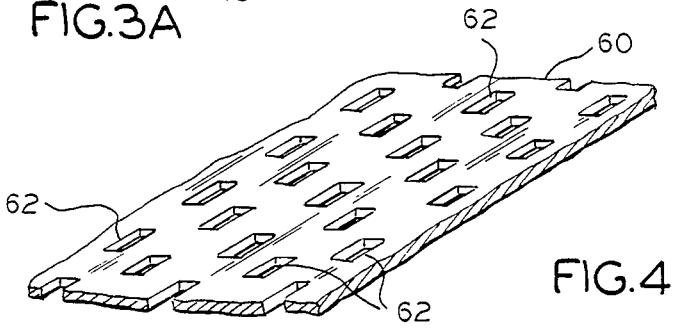
FIG. 4 is a perspective view taken in broken section, of a porous mesh screen for use in the muffler of the invention.
Figure 5:
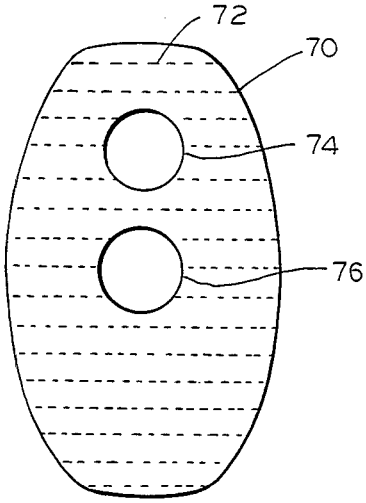

As further shown in FIG. 3, and in detail in FIG. 4, a screen 60 having elongated slits 62 therein is provided between catalyst pellets 50 and porous portion member 20 to prevent loss of pellets 50 through openings 44 of partition screen 22. Similarly, screen 60 is also provided between catalyst pellets 50 and exhaust port 46 to prevent loss of pellets 50 through openings 48 of port 46. Screen 60, as shown in FIG. 4 has elongated slots 62 therein which occupy about fifty percent of the available surface of screen 60.

Figure 3A:
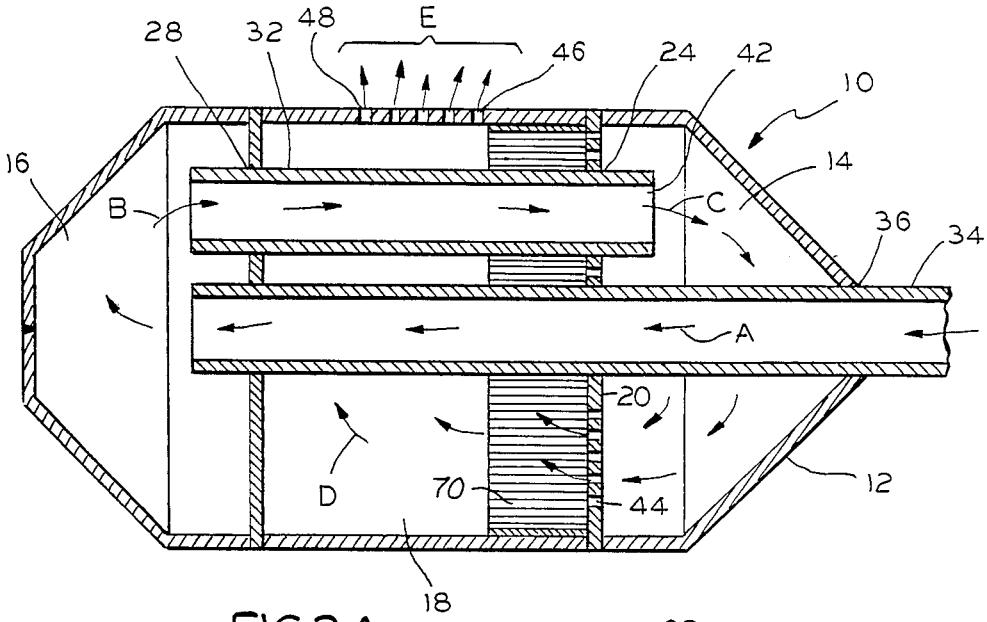

In a further embodiment as shown in FIG. 3A, a monolithic catalyst substrate 70 may be provided in chamber 18. Catalyst 70, may be a monolithic substrate having pores D2 running through the width thereof.

In each of the embodiments shown in FIG. 3 and FIG. 3A, exhaust gases flowing out of second fluid conductor 32 pass through aperture 44 and through the catalyst material 50 before exiting through the exhaust port 48. The remainder of the operation of the mufflers shown in FIG. 3 and FIG. 3A is the same as described in conjunction with the embodiment of FIG. 1. As can be seen from FIG. 3 and FIG. 3A, the mufflers of these embodiments, except for the addition of the catalyst material, are substantially similar to the embodiment shown in FIG. 1. Thus, during operation of these mufflers, the exhaust gases flow in the direction of arrows A-E.

The mufflers of the alternative embodiments shown in FIG. 3 and FIG. 3A provide a unique combination of muffler and catalytic converter for use in small displacement industrial engines not heretofore provided by the prior art.

The noise abatement muffler of the present invention has been described with particular reference to configurations having two chambers separated by a single, intermediate chamber. In this respect, it should be noted that various other configurations ma also be developed while keeping within the scope of the invention. For example, a plurality of intermediate chambers may be provided between forward and rear chambers 14 and 16.

Although the present invention has been described in connection with the preferred embodiment thereof with reference to the accompanying drawings, it is intended that the above described preferred embodiment is to be illustrative of the invention. As such, it will be apparent to those skilled in the art that various modifications can be made without departing from the scope of the invention as set forth in the appended claims.

I claim:

1. A noise abatement muffler for an internal combustion engine, said muffler comprising:

a housing having a plurality of isolated, serially arranged chambers therein, said housing having an inlet port, first fluid conducting means extending through said inlet port to conduct exhaust gases to one of said isolated chambers, said housing including exhaust port means located between said inlet port and said one of said isolated chambers, said exhaust port means comprising a plurality of apertures extending through said housing, certain of said chambers being interconnected by second fluid conducting means for enabling exhaust gases transported to said one of said chambers by said first fluid conducting means to flow from said one of said chambers to another one of said chambers in a direction opposite to the flow of gases transported by said first fluid conducting means, and said another one of said chambers having a porous partition member for enabling said exhaust gases transported to said another one of said chambers by said second fluid conducting means to flow from said another one of said chambers in a direction opposite to the flow of gases transported by said second fluid conducting means to exit said housing through said exhaust port means.

2. A noise abatement muffler for an internal combustion engine, said muffler comprising:

a housing having a plurality of isolated, serially arranged chambers therein, said housing having an inlet port, first fluid conducting means extending through said inlet port to conduct exhaust gases to one of said isolated chambers, said housing including exhaust port means located between said inlet port and said one of said isolated chambers, said exhaust port means being located at an acute angle relative to said inlet port, certain of said chambers being interconnected by second fluid conducting means for enabling exhaust gases transported to said one of said chambers by said first fluid conducting means to flow from said one of said chambers to another one of said chambers in a direction opposite to the flow of gases transported by said first fluid conducting means, and said another one of said chambers having a porous partition member for enabling said exhaust gases transported to said another one of said chambers by said second fluid conducting means to flow from said another one of said chambers in a direction opposite to the flow of gases transported by said second fluid conducting means to exit said housing through said exhaust port means.

3. The noise abatement muffler of claim 2 wherein said angle is 90 degrees.

4. A noise abatement muffler for an internal combustion engine, said muffler comprising:

a housing having a plurality of isolated, serially arranged chambers therein, said housing having an inlet port, first fluid conducting means extending through said inlet port to conduct exhaust gases to one of said isolated chambers, said housing including exhaust port means located between said inlet port and said one of said isolated chambers, certain of said chambers being interconnected by second fluid conducting means for enabling exhaust gases transported to said one of said chambers by said first fluid conducting means to flow from said one of said chambers to another one of said chambers in a direction opposite to the flow of gases transported by said first fluid conducting means, and said another one of said chambers having a porous partition member for enabling said exhaust gases transported to said another one of said chambers by said second fluid conducting means to flow from said another one of said chambers in a direction opposite to the flow of gases transported by said second fluid conducting means to exit said housing through said exhaust port means, said porous partition member including a plurality of apertures on a portion thereof, said apertures being located in that portion of said porous partition member which is most distant from the location of said exhaust port means on said housing.

5. A noise abatement muffler for an internal combustion engine, said muffler comprising:

a housing having a plurality of isolated, serially arranged chambers therein, said housing having an inlet port, first fluid conducting means extending through said inlet port to conduct exhaust gases to one of said isolated chambers, said housing including exhaust port means located between said inlet port and said one of said isolated chambers, certain of said chambers being interconnected by second fluid conducting means for enabling exhaust gases transported to said one of said chambers by said first fluid conducting means to flow from said one of said chambers to another one of said chambers in a direction opposite to the flow of gases transported by said first fluid conducting means, said one of said chambers receiving said exhaust gases from said first fluid conducting means being separated from the other chambers in said housing by a non-porous partition member, and said another one of said chambers having a porous partition member for enabling said exhaust gases transported to said another one of said chambers by said second fluid conducting means to flow from said another one of said chambers in a direction opposite to the flow of gases transported by said second fluid conducting means to exit said housing through said exhaust port means.

6. A noise abatement muffler for an internal combustion engine, said muffler comprising:

a housing having a plurality of isolated, serially arranged chambers therein, said housing having an inlet port, first fluid conducting means extending through said inlet port to conduct exhaust gases to one of said isolated chambers, said housing including exhaust port means located between said inlet port and said one of said isolated chambers, certain of said chambers being interconnected by second fluid conducting means for enabling exhaust gases transported to said one of said chambers by said first fluid conducting means to flow from said one of said chambers to another one of said chambers in a direction opposite to the flow of gases transported by said first fluid conducting means, said exhaust port means being located in an additional chamber disposed between said one of said chambers and said another one of said chambers, and said another one of said chambers having a porous partition member for enabling said exhaust gases transported to said another one of said chambers by said second fluid conducting means to flow from another one of said chambers in a direction opposite to the flow of gases transported by said second fluid conducting means to exit said housing through said exhaust port means.

7. The noise abatement muffler of claim 5 wherein said non-porous partition member includes openings therein for supporting said first and said second fluid conducting means.

8. The noise abatement muffler of claim 4 wherein said porous partition member includes openings therein for supporting said first and said second fluid conducting means.

9. The noise abatement muffler of claim 7 wherein said first fluid conducting means and said second fluid conducting means are supported in air tight engagement with said openings of said non-porous partition member.

10. The noise abatement muffler of claim 8 wherein said first fluid conducting means and said second fluid conducting means are supported in air tight engagement with said openings of said porous partition member.

11. A noise abatement muffler for a stationary, low horsepower, internal combustion engine, comprising:

a housing having forward and rear, serially arranged chambers separated from each other by an intermediate chamber between said forward and rear chambers, said housing having an inlet port, and first fluid conducting means extending through said inlet port to conduct exhaust gases to said rear chamber, said housing having exhaust port means located in said intermediate chamber for removal of said exhaust gases from said housing, said forward and rear chambers being interconnected by a second fluid conducting means for enabling exhaust gases transported to said rear chamber by said first fluid conducting means to flow from said rear chamber to said forward chamber, said rear chamber being separated from said intermediate chamber by a non-porous partition member, and said forward chamber being separated from said intermediate chamber by a porous partition member having apertures therein for enabling exhaust gases transported to said forward chamber from said rear chamber by said second fluid conducting means to flow into said intermediate chamber to thereby exit said housing through said exhaust port means within said intermediate chamber at a sound pressure level in the range of 10–25 decibels lower than the sound pressure level of the exhaust gases received at said inlet port.

12. The noise abatement muffler of claim 11 wherein said exhaust port means comprises a plurality of apertures extending through the housing from said intermediate chamber.

13. The noise abatement muffler of claim 1 wherein said apertures in said porous partition member are located on that portion of said porous partition member opposite said exhaust port means on said housing.

14. The noise abatement muffler of claim 11 wherein said non-porous and porous partition members have openings therein for supporting said first and said second fluid conducting means.

15. The noise abatement muffler of claim 14 wherein said first and second fluid conducting means are supported in air tight engagement with said openings of said porous and non-porous partition members.

16. The noise abatement muffler of claim 11 wherein said exhaust port means is located at an angle of about 90 degrees relative to said inlet port.

17. The noise abatement muffler of claim 6 wherein a ceramic catalyst material for reducing the hydrocarbon, carbon monoxide and nitrous oxide content of said exhaust gas is provided in said additional chamber whereby said exhaust gases flow through said catalyst prior to exiting said exhaust port.

18. The noise abatement muffler of claim 17 wherein said catalyst material is in the form of pellets.

19. The noise abatement muffler of claim 17 wherein said catalyst material is in the form of a monolithic preform.

20. The noise abatement muffler of claim 11 wherein a ceramic catalyst material for reducing the hydrocarbon, carbon monoxide and nitrous oxide content of said exhaust gases is provided in said intermediate chamber whereby said exhaust gases flow through said catalyst prior to exiting said exhaust port.

21. The noise abatement muffler of claim 20 wherein said catalyst material is in the form of a monolithic preform.

* * * * *